US007762165B2

(12) United States Patent
Kimura

(10) Patent No.: US 7,762,165 B2
(45) Date of Patent: Jul. 27, 2010

(54) METHOD OF MANUFACTURING OPTICAL ELEMENT HAVING ANNULAR ZONES AND METHOD OF MANUFACTURING MOLD FOR FORMING THE SAME

(75) Inventor: Shintaro Kimura, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 641 days.

(21) Appl. No.: 11/404,825

(22) Filed: Apr. 17, 2006

(65) Prior Publication Data

US 2006/0234607 A1 Oct. 19, 2006

(30) Foreign Application Priority Data

Apr. 19, 2005 (JP) ..... 2005-121338

(51) Int. Cl.
*B23B 1/00* (2006.01)
*B23B 5/40* (2006.01)
*G02B 3/08* (2006.01)

(52) U.S. Cl. ..... 82/1.11; 82/123; 82/158; 82/161

(58) Field of Classification Search ..... 82/1.11, 82/123, 148, 173, 901
See application file for complete search history.

(56) References Cited

U.S. PATENT DOCUMENTS 4,456,344 A * 6/1984 Bordignon ..... 359/742
5,638,212 A * 6/1997 Meyers et al. ..... 359/569
5,715,091 A * 2/1998 Meyers ..... 359/565
5,770,120 A * 6/1998 Kamihara et al. ..... 264/1.27
6,726,859 B2 * 4/2004 Sekiguchi et al. ..... 264/2.5
6,738,202 B2 * 5/2004 Hosoe ..... 359/742
6,965,476 B2 * 11/2005 Sato ..... 359/569
2002/0060857 A1 * 5/2002 Hosoe ..... 359/719
2004/0113299 A1 * 6/2004 Hosoe ..... 264/2.5
2005/0168839 A1 * 8/2005 Kimura ..... 359/742
2006/0144093 A1 7/2006 Hosoe
2006/0230889 A1 * 10/2006 Kimura ..... 82/1.11

FOREIGN PATENT DOCUMENTS

JP 09-230121 5/1997
JP 2000-246614 A 9/2000
JP 2003-62707 A 3/2003
JP 2005305555 A * 11/2005
JP 2006334688 A * 12/2006
WO 02/29451 A1 4/2002

* cited by examiner

*Primary Examiner*—Boyer D Ashley
*Assistant Examiner*—Sara Addisu
(74) *Attorney, Agent, or Firm*—Sughrue Mion, PLLC

(57) ABSTRACT

There is provided a method of manufacturing an optical element having a circular portion and at least one annular zone formed thereon, the circular portion having a circular profile and centered about an optical axis as viewed from a direction of an optical axis, the annular zone having an annular zonal face and a boundary wall face formed concentrically around a periphery of the circular portion, and the boundary wall face linking between the circular portion and the annular zonal face. The method is performed by rotating a workpiece about a rotation axis corresponding to the optical axis, and allowing a sharply pointed front end of a tip to prick the workpiece to a portion corresponding to an angled portion defined by the annular zonal face and the boundary wall face so that the annular zonal face is formed by side edges of a rake face of the tip.

12 Claims, 7 Drawing Sheets

METHOD OF MANUFACTURING OPTICAL ELEMENT HAVING ANNULAR ZONES AND METHOD OF MANUFACTURING MOLD FOR FORMING THE SAME

CROSS-REFERENCE TO RELATED APPLICATION

This application claims the benefit of Japanese Patent Application No. 2005-121338 filed on Apr. 19, 2005, the disclosure of which is incorporated herein by reference.

BACKGROUND OF THE INVENTION

1. Field of the Invention

The present invention relates to a method of manufacturing an optical element having annular zones centered about an optical axis and a method of manufacturing a mold for forming an optical element having annular zones to mold the same.

2. Description of the Related Art

In general, an optical element such as a Fresnel lens and a blaze type diffraction optical element having a spherical face centered about an optical axis and having a plurality of minute, protruding annular zones formed around a periphery of the spherical face thereof, is manufactured using a mold having formed therein a concave portion corresponding to the spherical portion of the optical element and annular grooves corresponding to the minute annular zones of the optical element. As a general method of manufacturing such a mold with annular grooves, there has been known a method of cutting the minute annular grooves by means of a tip. In a case of an optical element such as a phase shift element having a circular face centered about an optical axis in plan view and having a plurality of annular zonal faces formed in a step-like manner around a periphery of the circular face thereof, a turning process is directly provided for the optical element by means of a tip and the like. In a method of cutting by means of a tip such an optical element having annular zonal faces thereon formed in a step-like manner or a mold having above-mentioned annular grooves, since a front end shape of the tip is transferred onto each angle portion of the steps of the optical element or each angle portion of the annular grooves of the mold, it is desirable to make the front end shape of the tip acutely pointed. However, if the front end shape of the tip is made acutely pointed, this may cause deteriorating the surface roughness of the processed face.

Conventionally, the front end of a tip 21, which is a cutting tool, has a round form with a minute radius (with a minute R) as shown in FIG. 6 to form minute annular grooves in a mold, as disclosed in JP-A-2003-62707 (Paragraph 0059, FIGS. 3 and 6). Specifically, with a rake face 21*a* of the tip 21 set perpendicular to a rotation direction of a solid cylindrical workpiece W, the tip 21 is moved at an appropriate timing in the axial direction of the workpiece W while being moved continuously along a radial direction of the cylindrical workpiece W, whereby allowing the front end of the tip 21 to trace along wave-like processed faces PF which has been roughly processed, so as to form minute annular grooves 7 as shown in FIG. 7. According to the above-mentioned method, the surface roughness is more improved in comparison to a case where the front end of the tip 21 is sharply pointed, and a bottom portion of each annular groove 7 can be formed to be of a minute, rounded shape. The above method can be considered as applicable to an optical element of which annular zonal faces are formed in a step-like manner, as well.

However, although the above-mentioned method can improve the quality of the surface roughness somewhat higher than the case where the front end of the tip 21 is sharply pointed, the surface roughness still does not reach a desirable level, compared to cutting quality in use of a conventional-type tip. There is another method of cutting using a tip at an extremely low feeding speed thereof, so that a surface roughness can be as preferable as possible. However, this method increases the processing time, and may cause lowering of the temperature stability in the processing environment, resulting in a high possibility of deterioration in the resulting shape. Furthermore, since the tip has a narrower front end, abrasion of the tip becomes greater in comparison to a conventional-type tip.

Thus, it is an object of the present invention to provide a method of manufacturing an optical element having annular zones and a method of manufacturing a mold therefor, whereby the surface roughness can be improved without taking up more time.

SUMMARY OF THE INVENTION

An aspect of the present invention provides a method of manufacturing an optical element having a circular portion and at least one annular zone formed thereon, the circular portion having a circular profile and centered about an optical axis as viewed from a direction of an optical axis, the annular zone including an annular zonal face and a boundary wall face formed concentrically around a periphery of the circular portion, and the boundary wall face linking between the circular portion and the annular zonal face or linking between the annular zonal faces. The method is performed by rotating a workpiece about a rotation axis corresponding to the optical axis, and allowing a sharply pointed front end of a tip to prick the workpiece to a portion corresponding to an angled portion defined by the annular zonal face and the boundary wall face so that at least the annular zonal face is formed by side edges of a rake face of the tip.

Another aspect of the present invention provides a method of manufacturing a mold for forming an optical element having a circular portion and at least one annular zone formed thereon, the circular portion having a circular profile and centered about an optical axis as viewed from a direction of an optical axis, the annular zone including an annular zonal face and a boundary wall face formed concentrically around a periphery of the circular portion, and the boundary wall face linking between the circular portion and the annular zonal face or kinking between the circular portions. The method is performed by rotating a workpiece about a rotation axis corresponding to the optical axis, and allowing a sharply pointed front end of a tip to prick the workpiece to a portion corresponding to an angle defined by the annular zonal face of the mold and the boundary wall face of the mold so that at least the annular zonal face of the mold is formed by side edges of a rake face of the tip.

Other aspect, features and advantages of the present invention will become apparent upon reading the following specification and claims when taken in conjunction with the accompanying drawings.

BRIEF DESCRIPTION OF THE DRAWINGS

FIG. 4A is a partially enlarged plan view illustrating a relationship between a rake face of the tip and a line along a radial direction of the workpiece, and FIG. 4B is a partially enlarged plan view illustrating an incline of the tip with respect to a cross section along a radial direction of the workpiece.

FIG. 7A is a plan view of a processed face of a workpiece, and FIG. B is a sectional view taken on

DETAILED DESCRIPTION OF PREFERRED EMBODIMENT

An embodiment of the present invention will be described herein in details, with reference to the drawings.

Figure 1:
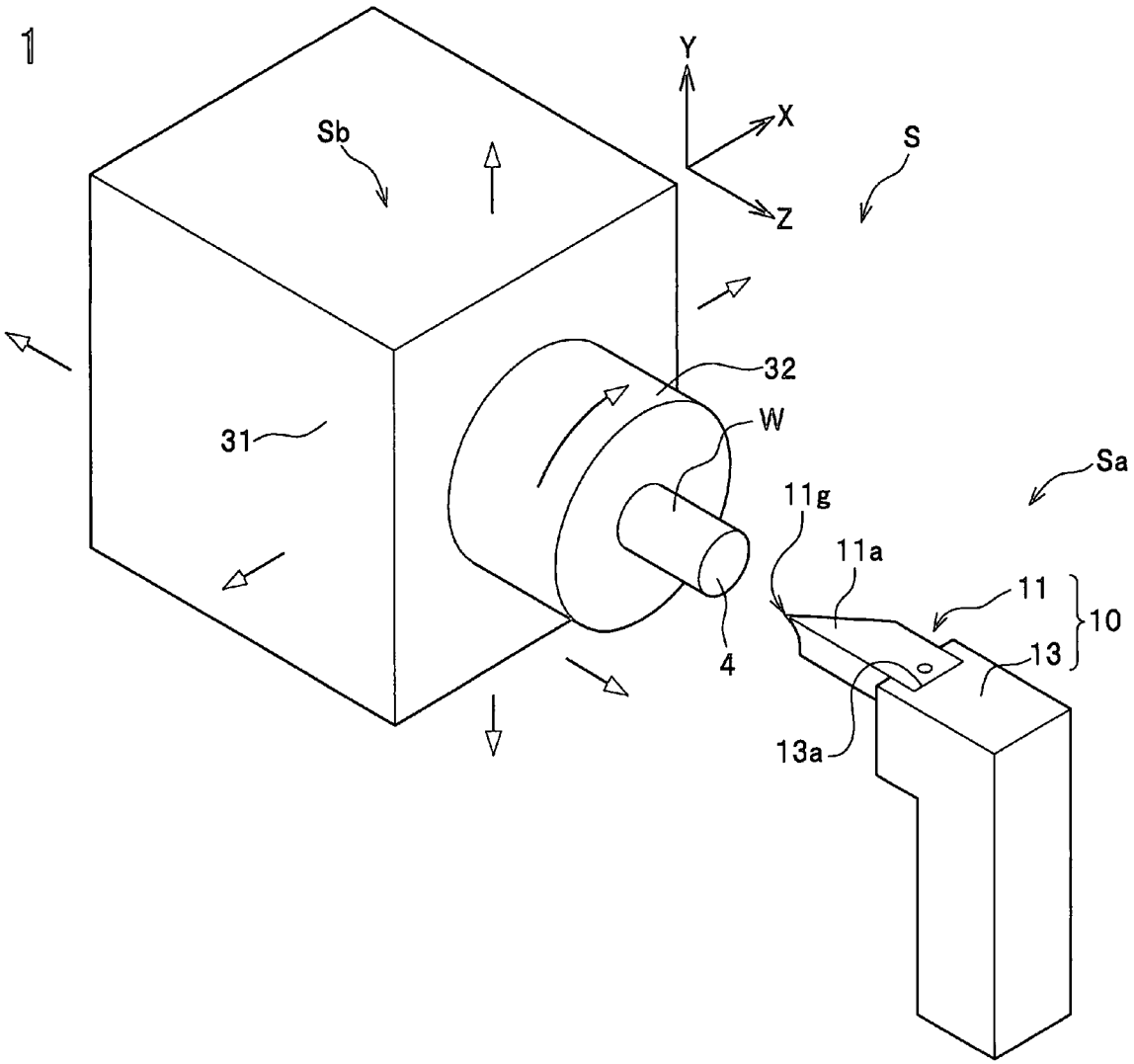
FIG. 1 is a perspective view of a turning device for use in an embodiment.

As shown in FIG. 1, the turning device S has, as main components, a tool portion Sa including a turning tool 10, and a head portion Sb onto which a solid cylindrical workpiece W is mounted. Details of the respective portions will be described below. Note that, for the sake of convenience, the workpiece W and a tip 11 are depicted in FIG. 1 in an proportion in size that differs from that of the actual dimensions. The actual size relationship of the workpiece W and the tip 11 is as shown in FIG. 3.

[Tool Portion]

The tool portion Sa is mainly constituted of the turning tool 10 having the tip 11, and this turning tool 10 is detachably fixed to a base (not shown in the drawing).

The turning tool 10 is mainly constituted of the tip 11 and a shank 13 (also referred to as a tip holder or main turning tool body), onto which the tip 11 is detachably mounted.

Figure 2:
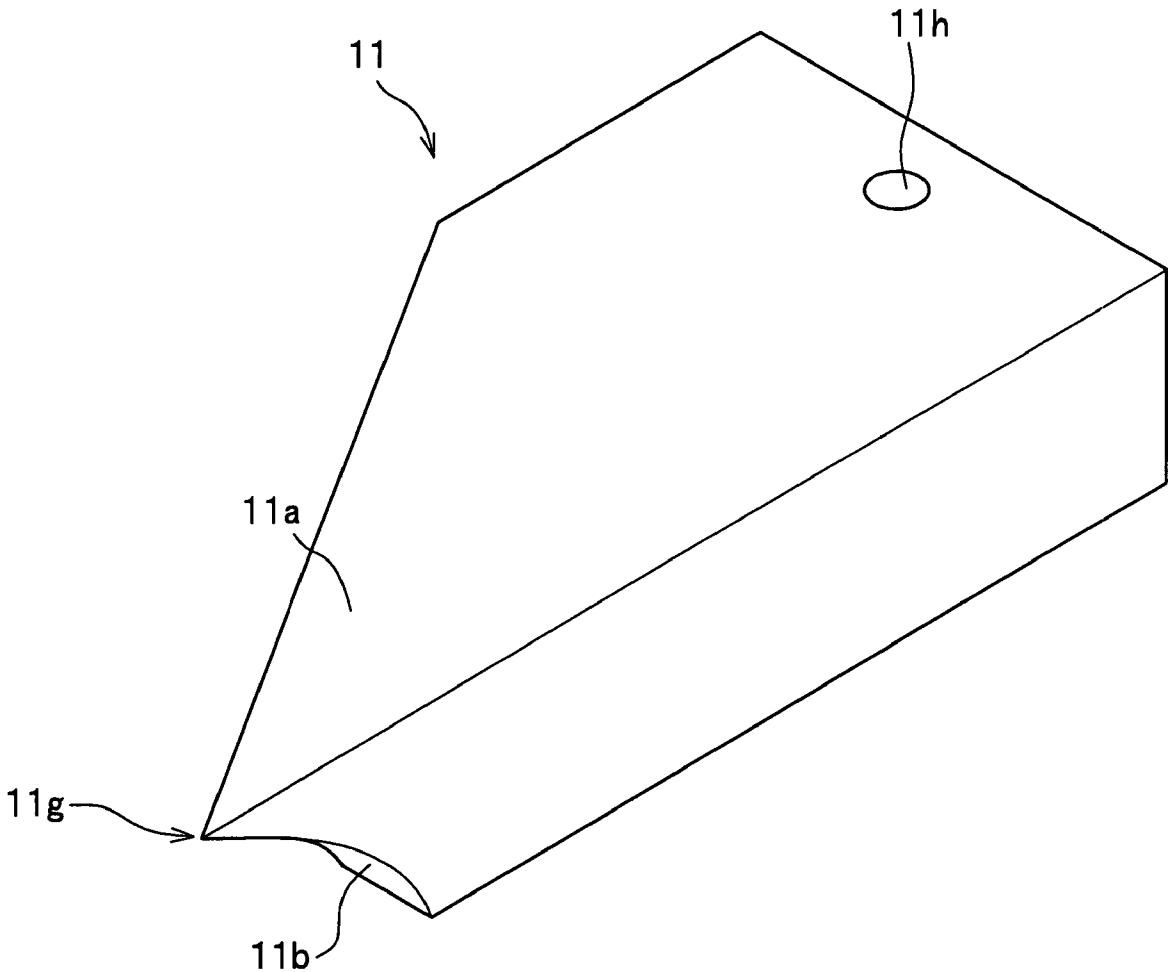
FIG. 2 is an enlarged perspective view of a tip.

As shown in FIG. 2, the tip 11 is formed in such a manner that the front end portion thereof becomes tapered to a point at a front end 11*g*, which is to be pressed against the workpiece dominant role in cutting the workpiece W. In the front end portion of the tip 11, a flank 11*b* for avoiding interference with the workpiece W is formed continuously to the front end 11*g*. The rake face 11*a* is formed such that one side edge thereof is formed in a straight line extending along a rotation axis of the workpiece W between a base end portion and the front end 11*g* of the tip 11, and the other side edge thereof is formed in a straight line that is inclined so as to gradually depart from the one side edge starting from the front end 11*g* toward the base end portion of the tip 11. Accordingly, the tip 11 is formed so that the front end 11*g* is sharply pointed.

A bolt hole 11*h* is formed in a base end portion of the tip 11, so that the tip 11 is detachably mounted to a tip holding portion 13*a* (see FIG. 1) of shank 13 by a bolt (not shown in the drawing). The method of fixing the tip 11 to the shank 13 is not restricted to the method using a bolt, and a brazing method and the like, may be used instead.

As shown in FIG. 1, the shank 13 is an arm that is shaped substantially like an inverted L, and has the tip holding portion 13*a* for holding the tip 11 formed at one end thereof. The other end of the shank 13 is detachably fixed to the base (not shown in the drawing). The tip 11 is held by the shank 13 in such a manner that rake face 11*a* thereof faces substantially upward.

[Head Portion]

A head portion Sb mainly has a moving stage 31 for varying the relative positions of the workpiece W and the tip 11 in three dimensions and a chuck 32 for holding and rotating the workpiece W.

The moving stage 31 has a front/rear movement mechanism, a left/right movement mechanism, and an up/down movement mechanism that are un-illustrated, and is thereby enabled to move in three of front/rear, left/right and up/down directions relative to the tool portion Sa. In other words, as illustrated by the coordinate axes of FIG. 1, the moving stage 31 is made movable along a Z-axis of the front/rear direction parallel to a main axis line of the head portion Sb, and along an X-axis of the left/right direction and a Y-axis of the up/down direction that are orthogonal to the Z-axis.

The chuck 32 is a portion onto which the solid cylindrical workpiece W is mounted and the workpiece W is held on an outer peripheral face of the workpiece W by means, for example, of a vacuum chuck or a plurality of un-illustrated jaws (also referred to as claw or collets) serving as the chuck 32. This chuck 32 is rotatably mounted onto the moving stage 31 and is rotated at a predetermined speed by a driving motor (not shown in the drawing), etc. Note that the rotation speed of the chuck 32 can be changed as desired.

Figure 3A:
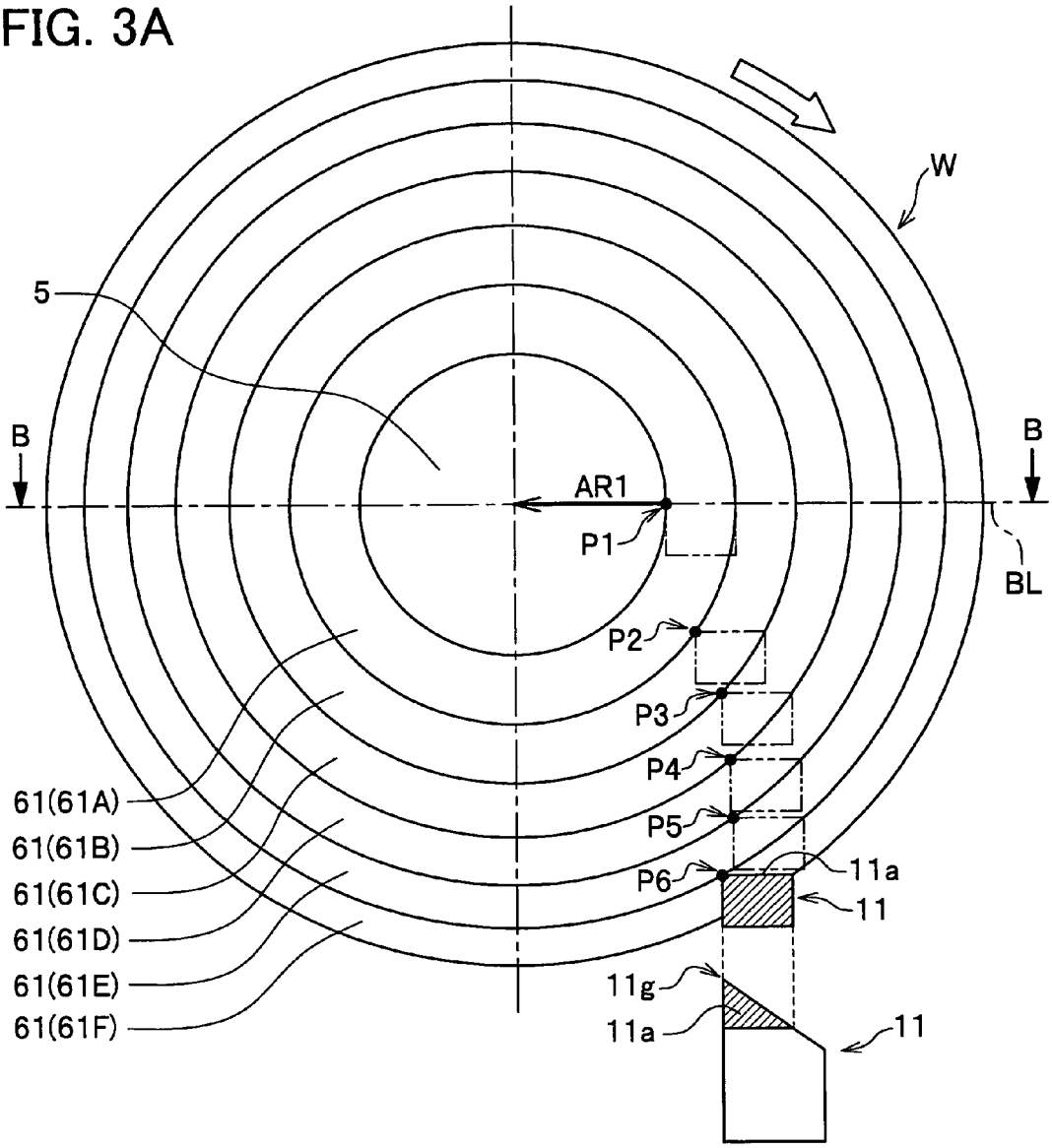
FIG. 3A is a plan view of a processed face of a workpiece.
Figure 3B:
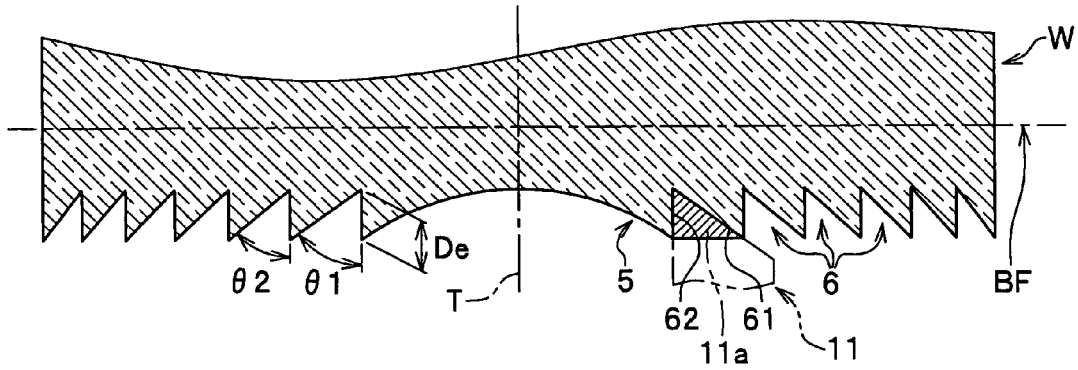
FIG. 3B is a sectional view taken on B-B of FIG. 3A.

The workpiece W is to be a base material of a concave Fresnel lens (optical element having annular zones). Specifically, as shown in FIGS. 3A and 3B; a concave portion 5, which is formed into a substantially circular shape centered about the optical axis of the above-mentioned Fresnel lens in plan view, and a plurality of annular grooves 6, formed concentrically around a periphery of the concave portion 5, are formed on a processed face 4 of the workpiece W by means of the tip 11. The above-mentioned concave portion 5 is also referred to as the "circular portion", and the annular grooves 6 are also referred to as "annular zonal faces and boundary wall faces".

As shown in FIG. 3B, each annular groove 6 has an inclined annular zonal face 61 and a boundary wall face 62 that is substantially perpendicular to a workpiece reference plane BF. Note that the workpiece base plane BF is a virtual plane orthogonal to a rotation axis T of the workpiece W. The respective annular grooves 6 are formed in such a manner that an angle between an annular zonal face 61 and a boundary wall face 62 thereof in a cross section cut along a plane extending in axial direction of the workpiece W becomes narrower as the corresponding annular zonal face 61 is at a more outward position in the radial direction. In the description as follows, the plurality of annular zonal faces 61 will also be referred to as a first annular zonal face 61A, a second annular zonal face 61B, a third annular zonal face 61C, a fourth annular zonal face 61D, a fifth annular zonal face 61E, and a sixth annular zonal face 61F, in that order from the center, for the sake of convenience.

A method of manufacturing a Fresnel lens by the above-described turning device S will be described as follows.

In the present embodiment, the face 4 of the workpiece W to be processed is substantially. flat and is not roughly processed in advance.

As shown in FIG. 1, first, chuck 32 is driven to rotate to thereby rotate the workpiece W about the rotation axis T corresponding to the optical axis of the above-mentioned Fresnel lens (see FIG. 3B), and the workpiece W is moved by means of the moving stage 31 so that the front end 11*g* of the tip 11 is set at a first processing position P1 (see FIG. 3A). The first processing position P1 refers to a position at which a baseline BL extending through the center of the workpiece W in a radial direction (horizontal direction) intersects an outer peripheral edge of the concave portion 5 (unprocessed), that is, a position slightly apart from the outer peripheral edge of the concave portion 5 toward this (viewer's) side of the drawing. It can be deemed that the tip 11 moves relative to the workpiece W if the workpiece W is moved by the moving stage 31, as explained below. However, only a description will be provided simply on the relative movement of the tip 11 with respect to the workpiece W, omitting a description of the movement of the workpiece W by the moving stage 31 for the sake of convenience.

As shown in FIG. 3A, the tip 11 is moved once toward the workpiece W so that the tip 11 pricks the workpiece W by a predetermined amount and is then moved in the direction of an arrow AR1 (in the inward direction and in the left direction of the drawing) to form the concave portion 5 on the workpiece W. Since the face of concave portion 5 is formed by the sharply pointed front end 11*g* of the tip 11, the rotation speed of the workpiece W is preferably set to a comparatively slow speed to improve the surface roughness.

When the forming of the concave portion 5 is finished, the tip 11 is once moved away from the workpiece W, then towards the right direction, so that the front end 11*g* of the tip 11 is positioned at the original first processing position P1. Then, after changing the rotation speed of the workpiece W from the above-mentioned slower speed back to the normal faster speed, the tip 11 is allowed to prick (so as referred to as "be engaged with") the workpiece W to a predetermined depth De (portion corresponding to the angle portion of the annular groove 6) to form the annular groove 6 with a predetermined angle θ1 (angle defined by the first annular zonal face 61A and the boundary wall face 62) by the outer edges of the tip 11.

Figure 4A:
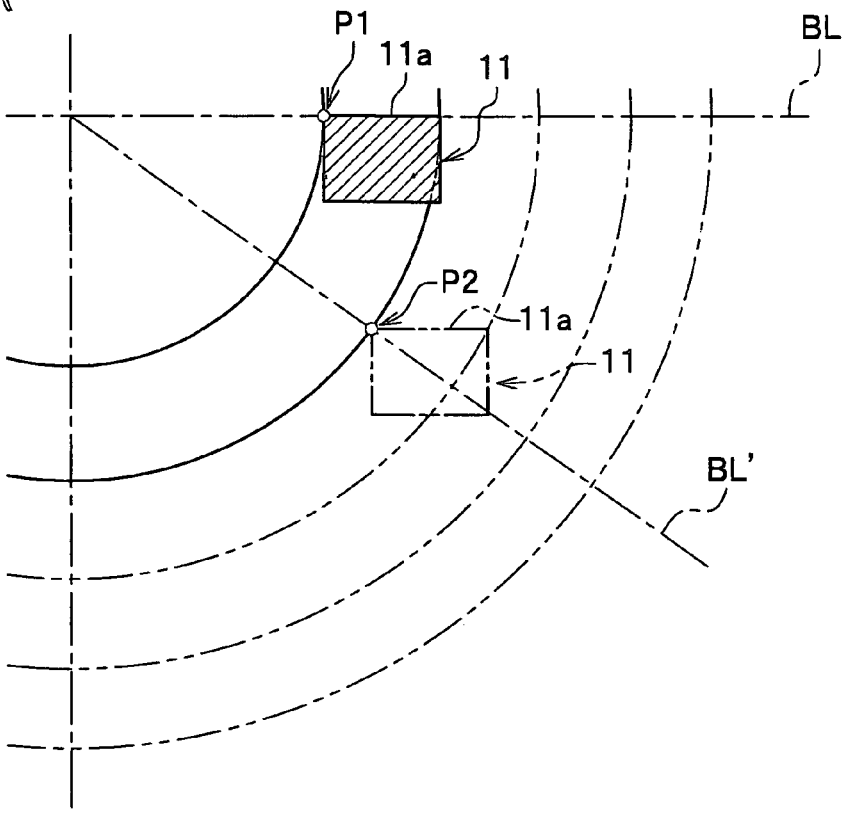
FIGS. 4A and 4B show diagrams of a relationship between a first processing point and a second processing point when the tip is shifted in a rotation direction of a workpiece.
Figure 4B:
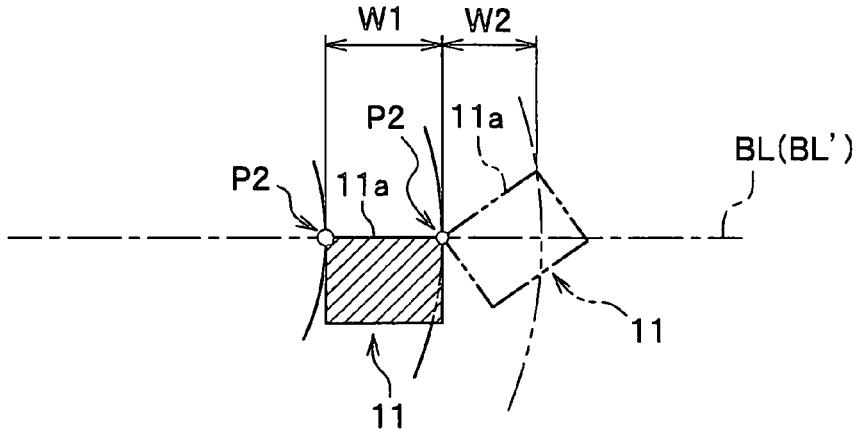

After forming of the first annular groove 6 (defined by the first annular zonal face 61A and the boundary wall face 62), the tip 11 is moved away again from the workpiece W and thereafter, in a lower right direction, so that the front end 11*g* of the tip 11 is positioned at a second processing position P2. Note that the second processing position P2 denotes a position that is shifted from the first processing position P1 in the rotation direction of the workpiece W by a predetermined distance, and also that is located on the outer peripheral edge of the first annular zonal face 61A (to be specific, a position slightly apart from the position on the outer peripheral edge thereof toward this side of the drawing) The tip 11 is positioned at the second processing position P2, where the tip 11 pricks the workpiece W by the above-mentioned depth De. Accordingly, the annular groove 6 with a predetermined angle θ2 (angle defined by the second annular zonal face 61B and the boundary wall face 62) is formed by the outer edge of the tip 11. Note that the predetermined angle θ2 is made smaller than the above-mentioned predetermined angle θ1. This is because, as shown in FIG. 4A, whereas at the first processing position P1, the rake face 11*a* of the tip 11 is parallel to a line (reference line BL) extending through the first processing position P1 in the radial direction of the workpiece W, at the second processing position P2, the rake face 11*a* of the tip 11 is inclined at a predetermined angle relative to a line BL' extending through second processing position P2 in the radial direction of the workpiece W. To be specific, if the above-mentioned baseline BL and the line BL' are aligned together, it appears, in FIG. 4B, as if the tip 11 positioned at the second processing position P2 becomes inclined to the tip 11 positioned at the first processing position P1 at a predetermined angle. Hence, a shape is formed within the cross section along baseline BL as if the outer edge shape of the inclined tip 11 is shadowed (that is, the width W1 of the annular groove 6 on the inner side becomes smaller than the width W2 of the annular groove 6 on the outer side) The annular grooves 6 are thus formed such that each angle thereof differs from one another, as shown in FIG. 3B.

Thereafter, the tip 11 is positioned continuously at a third processing position P3, a fourth processing position P4, a fifth processing position P5, and then a sixth processing position P6 each of which is defined at a predetermined distance therebetween in the rotation direction of the workpiece W. At each corresponding position, the tip 11 is allowed to prick the workpiece W, so that the annular grooves 6 having different angles can be formed respectively. As is clear from the above description, the annular grooves 6 have narrower angles as the grooves 6 are at a more outward position in the radial direction, i.e., in the direction departing from the baseline BL that accords with the rake face 11*a*. As with the above-described second processing position P2, etc., the processing positions P3 to P6 are set on the outer peripheral edges of the corresponding annular zonal faces 61 of 61B, 61C, 61D, 61E respectively, that is, at the corresponding positions slightly apart outward from one to another in the direction of this side of the drawing.

According to the above explanation, the present embodiment provides the following effects.

Since each annular groove 6 (defined by the annular zonal face 61 and the boundary wall face 62) can be easily and preferably formed by the outer edge of the tip 11 simply by piercing the front end of the tip 11 into the workpiece W, processing can be performed to realize good surface roughness with reduced time.

Since the angle of each annular groove 6 can be easily changed by simply shifting the position of the tip 11 in the rotation direction of the workpiece W, an annular optical element having the annular grooves 6 which differ in angle can be formed extremely easily. Since the angle portion of each annular groove 6 is formed by the tip 11 with the front end 11*g* thereof sharply pointed, the angle portion can be formed to be sharpened.

The present invention is not restricted to the above-described embodiment and can be put into practice in various modes.

In the above described embodiment, the boundary wall face 62 is made perpendicular to the workpiece base plane BF. However, the present invention is not limited thereto and the boundary wall face 62 may be made inclined by changing the outer edge shape of the tip 11. An optical component having a tapered boundary wall face can also be formed satisfactorily.

In the above embodiment, although the moving stage 31 movable in three axial directions is disposed on the head portion Sb side, the present invention is not limited thereto. For example, other structures can be employed, in which the head portion Sb side is fixed, and a moving stage movable in three axial directions (front/rear, left/right and up/down) is disposed on the tool portion Sa side, the head portion Sb side is also fixed and the moving stage movable in one axial direction (for example, front/rear alone) is disposed at the head portion Sb side, and a moving stage movable in two axial directions (for example, left/right and up/down) is disposed at the tool portion Sa side, etc.

In the above embodiment, although the concave portion 5, first annular zonal face 61A, and second annular zonal face 61B to sixth annular zonal face 61F are formed as in this order, the order of forming the annular zonal faces is not limited thereto. For example, the order of the zonal faces in the above-described embodiment may be reversed. Although the concave portion 5 is formed with the tip 11 having a sharply pointed end in the above-described embodiment, the present invention is not limited thereto. When the concave portion 5 is formed, another tip 11 having a front end in a gradually rounded shape may be used without lowering the rotation speed of the workpiece W.

In the above embodiment, although a concave Fresnel lens is employed as the annular optical element, the present invention is not limited thereto. For example, a cut resin optical product, a germanium lens, or a metal mirror and the like may be employed instead. The object of manufacturing is not limited to an annular optical element, and a mold for molding such an annular optical element (for example, a convex Fresnel lens) may be employed.

Figure 7A:
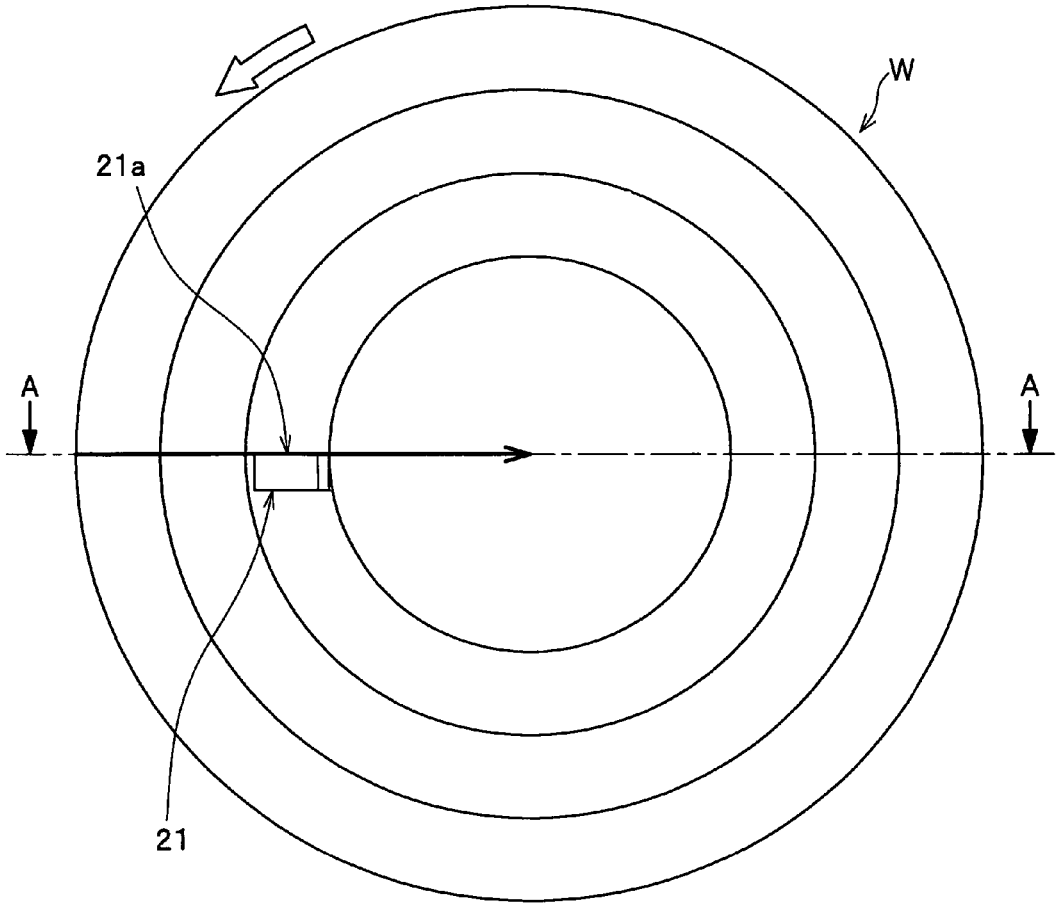
FIG. 7A PRIOR ART
FIGS. 7A and 7B show diagrams of a prior-art method of manufacturing a mold.
Figure 7B:
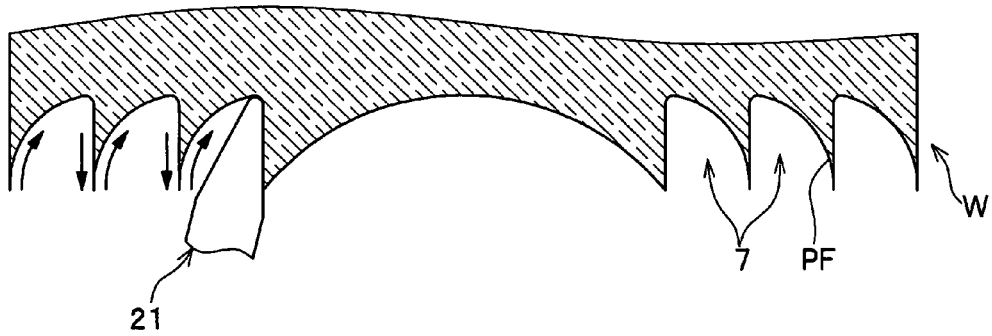
FIG. 7B PRIOR ART

In the above embodiment, although the present invention is applied to an optical element having the annular zonal faces 61 of which the cross-sectional shape is a straight line. The present invention can also be applied, if changing the outer edge shape of the tip 11, to an optical element having the annular zonal faces 61 of which the cross-sectional shape is a curved surface, as shown in FIG. 7 for the prior art.

Figure 5A:
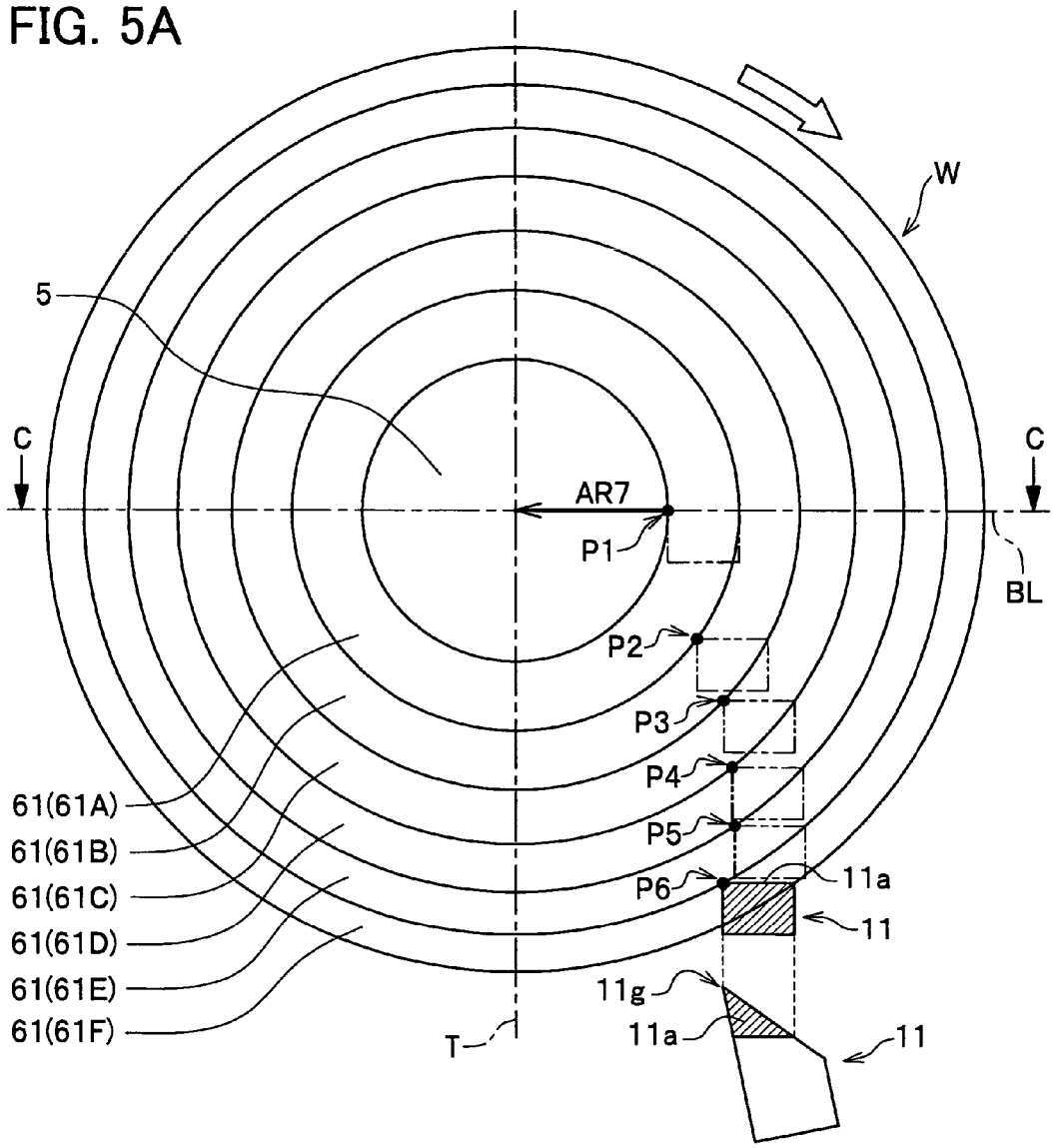
FIG. 5A is a plan view of an embodiment in which an annular zonal face is formed with an edge portion of one side of the tip.
Figure 5B:
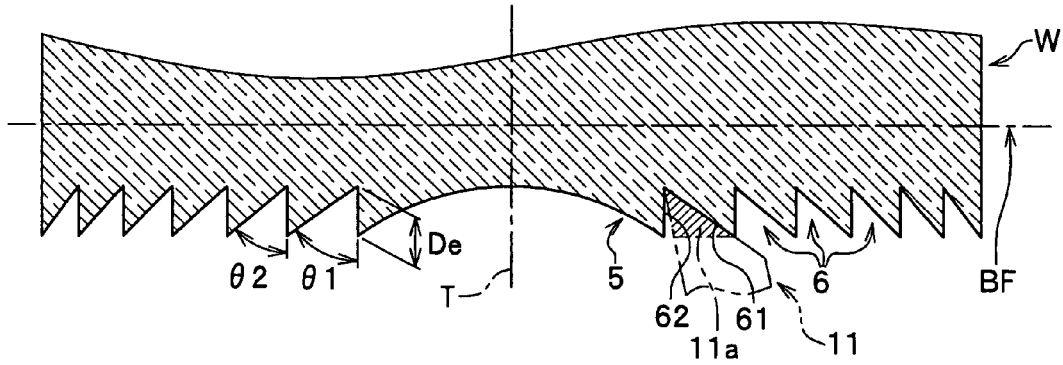
FIG. 5B is a sectional view taken on C-C of FIG. 5A.
Figure 6:
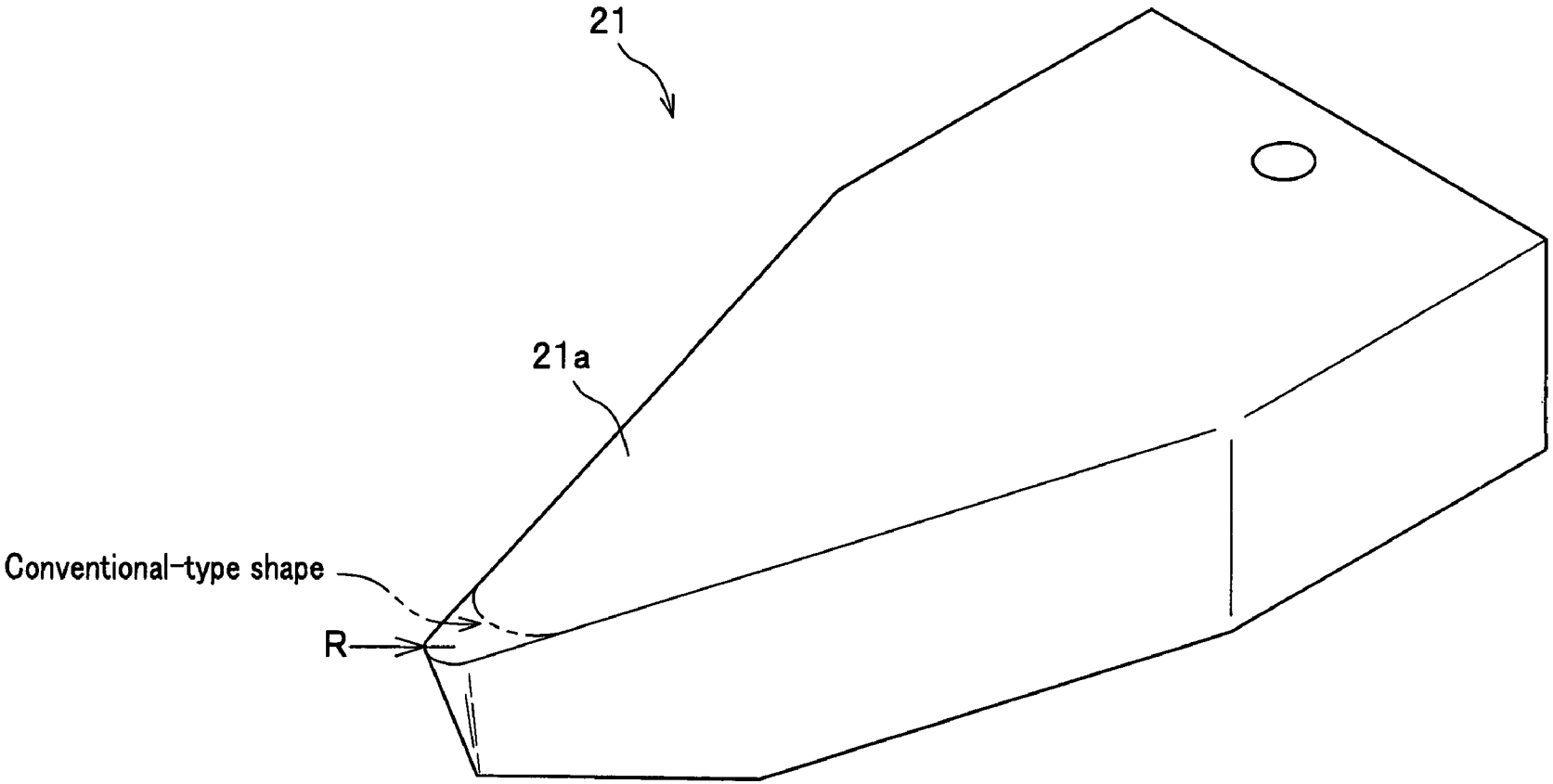
FIG. 6 PRIOR ART
FIG. 6 is an enlarged perspective view of a prior-art tip having a small front end radius.

In the above-described embodiment, although each annular groove 6 is cut by the tip 11 at each edge side thereof, the present invention is not limited thereto. For example, if tilting the tip 11 of the present embodiment toward the outer edge of the workpiece W, as shown in FIGS. 5A and 5B, the annular zonal face 61 may be formed with an edge on one side of the tip 11, and the boundary wall face 62 may be formed with the front end thereof.

The embodiments according to the present invention have been explained as aforementioned. However, the embodiments of the present invention are not limited to those explanations, and those skilled in the art ascertain the essential characteristics of the present invention and can make the various modifications and variations to the present invention to adapt it to various usages and conditions without departing from the spirit and scope of the claims.

What is claimed is:

1. A method of manufacturing an optical element having a circular portion and at least a first and a second annular zone formed thereon, the circular portion having a circular profile and centered about an optical axis as viewed from a direction of an optical axis, each annular zone comprising an annular zonal face and a boundary wall face formed concentrically around a periphery of the circular portion, and each boundary wall face linking between the circular portion and the annular zonal face of the first annular zone or linking between the annular zonal faces of the first and the second annular zones, the method being performed by:

rotating a workpiece about a rotation axis corresponding to the optical axis; and allowing a sharply pointed front end of a tip to prick the workpiece to a portion corresponding to an angled portion defined by each annular zonal face and each boundary wall face so that at least each annular zonal face is formed by side edges of a rake face of the tip, wherein:

a direction parallel to the rotation axis is set to be a Z direction, a direction orthogonal to the Z direction and extending through a rotation center of the circular portion and a first position at which the front end of the tip pricks the workpiece when forming the first annular zone is set to be an X direction, and a direction orthogonal to the Z direction and to the X direction is set to be a Y direction, the method further comprises setting a second position at which the front end of the tip pricks the workpiece when forming the second annular zone at a position shifted from the first position in the X direction and the Y direction, so as to incline the rake face of the tip at a predetermined angle relative to a line extending through the rotation center and the second position, thereby to change an angle of the angled portion defined by each annular zonal face and boundary wall face between the first and the second annular zones.

2. The method according to claim 1 further comprising replacing the sharply pointed tip with a tip having a moderately rounded R shape at a front end thereof, to form the circular portion.

3. The method according to claim 1 further comprising rotating the workpiece at a lower speed to form the circular portion.

4. The method according to claim 1, wherein the optical element comprises a concave Fresnel lens.

5. The method according to claim 1, wherein the optical element comprises a cut resin product.

6. The method according to claim 1, wherein the optical element comprises a germanium lens.

7. The method according to claim 1, wherein the optical element comprises a metal mirror.

8. The method according to claim 1, wherein both side edges of the rake face of the tip are engaged with a face to be processed of the workpiece when the front end of the tip pricks the face.

9. The method according to claim 1, wherein one of two side edges of the rake face of the tip is engaged with a face to be processed of the workpiece when the front end of the tip pricks the face.

10. A method of manufacturing a mold for forming an optical element having a circular portion and at least a first and a second annular zone formed thereon, the circular portion having a circular profile and centered about an optical axis as viewed from a direction of an optical axis, each annular zone comprising an annular zonal face and a boundary wall face formed concentrically around a periphery of the circular portion, and each boundary wall face linking between the circular portion and the annular zonal face of the first annular zone or linking between the annular zonal faces of the first and the second annular zones, the method being performed by:

rotating a workpiece about a rotation axis corresponding to the optical axis; and allowing a sharply pointed front end of a tip to prick the workpiece to a portion corresponding to an angle defined by each annular zonal face of the mold and each boundary wall face of the mold so that at least each annular zonal face of the mold is formed by side edges of a rake face of the tip, wherein:

a direction parallel to the rotation axis is set to be a Z direction, a direction orthogonal to the Z direction and extending through a rotation center of the circular portion and a first position at which the front end of the tip pricks the workpiece when forming the first annular zone is set to be an X direction, and a direction orthogonal to the Z direction and to the X direction is set to be a Y direction, the method further comprises setting a second position at which the front end of the tip pricks the workpiece when forming the second annular zone at a position shifted from the first position in the X direction and the Y direction, so as to incline the rake face of the tip at a predetermined angle relative to a line extending through the rotation center and the second position, thereby to change an angle of the angled portion defined by each annular zonal face and boundary wall face between the first and the second annular zones.

11. The method according to claim 10 further replacing the sharply pointed tip with a tip having a moderately rounded R shape at a front end thereof, to form the circular portion.

12. The method according to claim 10 further comprising rotating the workpiece at a lower speed to form the circular portion.

* * * * *